US010030945B1

(12) United States Patent
Mol

(10) Patent No.: US 10,030,945 B1
(45) Date of Patent: Jul. 24, 2018

(54) BULLET TRAPPING APPARATUS

(71) Applicant: Gary R. Mol, Marblehead, OH (US)

(72) Inventor: Gary R. Mol, Marblehead, OH (US)

( * ) Notice: Subject to any disclaimer, the term of this patent is extended or adjusted under 35 U.S.C. 154(b) by 0 days.

(21) Appl. No.: 15/608,139

(22) Filed: May 30, 2017

(51) Int. Cl.
*F41J 13/00* (2009.01)
*F41J 13/02* (2009.01)

(52) U.S. Cl.
CPC ..... *F41J 13/00* (2013.01); *F41J 13/02* (2013.01)

(58) Field of Classification Search
CPC ..... F41J 13/00; F41J 13/02
USPC ..... 273/404, 410
See application file for complete search history.

(56) References Cited

U.S. PATENT DOCUMENTS 941,642 A * 11/1909 Maxim ..... F41J 13/00 273/410
2,013,133 A * 9/1935 Caswell ..... F41J 13/00 273/406
2,420,304 A * 5/1947 Diem ..... F41J 13/00 273/410
2,535,280 A * 12/1950 Gartrell ..... F41J 1/01 273/404
2,818,729 A * 1/1958 Ferguson ..... F41J 13/00 73/167
2,901,254 A * 8/1959 Fortson ..... F41J 13/02 273/404
4,201,385 A * 5/1980 Szabados ..... F41J 13/02 273/410
4,445,693 A * 5/1984 Angwin ..... F41J 13/00 273/404
4,458,901 A * 7/1984 Wojcinski ..... F41J 13/00 273/410
4,546,984 A * 10/1985 Towle ..... F41J 3/0019 273/404
4,773,653 A * 9/1988 Unverzagt ..... F41J 13/00 273/404
4,819,946 A * 4/1989 Kahler ..... F41J 13/00 273/404
4,856,791 A * 8/1989 McQuade ..... F41J 13/00 273/410
5,259,291 A * 11/1993 Wilson ..... F41J 13/00 273/410
5,366,105 A * 11/1994 Kerman ..... F41J 13/00 220/62.11

(Continued)

FOREIGN PATENT DOCUMENTS

FR 2865534 A1 * 7/2005
GB 500372 A * 2/1939 ..... F41J 13/00

*Primary Examiner* — Mark Graham
(74) *Attorney, Agent, or Firm* — Donald J. Ersler

(57) ABSTRACT

A bullet trap apparatus preferably includes a housing, a support structure and energy absorbing material. The housing preferably includes a bullet guiding collar, a front energy absorbing panel, a front wall plate, a four sided box, an angled back plate and an angled armor plate. The front wall plate is attached to a front of the four-sided box. The front energy absorbing panel is located between the bullet guiding collar and the front wall plate. A perimeter of the angled back plate is attached to a perimeter of a rear of the four-sided box. Four armor spacers are attached in four corners of the back plate. A rear of the angled armor plate is attached to the four armor spacers. The housing is filled with energy absorbing material. The support structure preferably includes a first side leg and a second side leg and three base plates.

4 Claims, 4 Drawing Sheets

(56) References Cited

U.S. PATENT DOCUMENTS

| | | | | | |
|---|---|---|---|---|---|
| 5,811,718 | A * | 9/1998 | Bateman | F41J 13/00 | 273/394 |
| 5,988,647 | A * | 11/1999 | Porter | F41J 13/00 | 273/410 |
| 6,016,735 | A * | 1/2000 | Langner | F41J 13/00 | 273/403 |
| 6,722,195 | B2 * | 4/2004 | Duke | F41J 13/00 | 273/410 |
| 8,550,466 | B2 | 10/2013 | Priebe et al. | | |
| 2011/0233870 | A1 * | 9/2011 | Oh | F41J 13/00 | 273/410 |
| 2012/0187631 | A1 * | 7/2012 | John | F41J 13/00 | 273/410 |
| 2016/0003584 | A1 * | 1/2016 | Durynski | F41J 13/02 | 273/410 |
| 2016/0116260 | A1 * | 4/2016 | Oh | F41J 13/00 | 273/410 |

* cited by examiner

BULLET TRAPPING APPARATUS

BACKGROUND OF THE INVENTION

1. Field of the Invention

The present invention relates generally to decelerating projectiles and more particularly, to a bullet trap apparatus, which includes increased bullet deceleration with an angled back plate.

2. Discussion of the Prior Art

In the past, bullet trapping systems were bulky and hard to set up in the field. Many were not portable and therefore could not be easily moved from location to location as may be desired. Some bullet trap systems use rubber grains and rubber nuggets. However, these types of medium have some disadvantages in their ability to efficiently capture a bullet therein and, further, they experience some severe degradation during extended use.

It is therefore desirable to have a portable bullet trap apparatus and a flowable bullet trap medium, which efficiently captures projectiles such as bullets and which can efficiently capture the projectiles such as bullets for extended periods of use without the need to frequently replace the medium. U.S. Pat. No. 8,550,466 to Priebe et al. discloses a bullet decelerating medium and bullet trapping system and method using the medium. However, the Priebe patent does not teach or suggest an angled back plate for reducing the deceleration of a bullet fired into the bullet trapping system. Priebe et al. is hereby incorporated by reference in its entirety into this application.

Accordingly, there is a clearly felt need in the art for a bullet trapping apparatus, which includes increased bullet deceleration with an angled back plate.

SUMMARY OF THE INVENTION

The present invention provides a bullet trapping apparatus, which includes increased bullet deceleration with an angled back plate. The bullet trap apparatus preferably includes a housing, a support structure and energy absorbing material. The housing preferably includes a bullet guiding collar, a front energy absorbing panel, a front wall plate, a four sided box, an angled back plate and an angled armor plate. The bullet guiding collar preferably includes a base plate, a four-sided peripheral wall and a four-sided angled flange. The base plate includes a rectangular base opening. The four-sided peripheral wall is preferably perpendicular to the base plate and is attached thereto. The four-sided angled flange is attached to the base plate and the four-sided peripheral wall. The front energy absorbing panel is preferably fabricated from a either a screen or a fabric layer laminated to a front of a rubber material. The front wall plate includes a rectangular opening formed therethrough. The four sided box includes a top plate, a bottom plate, a first side plate and a second side plate. The top, bottom, first side and second side plates are attached to each other to form the four-sided box. The top and bottom plates include a pentagon shape. The front wall plate is attached to a front of the four-sided box. The front energy absorbing panel is located between the base plate of the bullet guiding collar and the front wall plate.

The angled back plate includes a first angled back plate and a second angled back plate. Adjacent edges of the first and second angled back plate are joined to each other. A perimeter of the angled back plate is attached to a perimeter of a rear of the four-sided box. Preferably, four armor spacers are attached in four corners of the angled back plate. A rear of the angled armor plate is glued to the four armor spacers. A top edge of the bullet guiding collar is preferably hinged to a top of the four-sided box, such that a space is created for the insertion of the front energy absorbing panel. A bottom edge of the bullet guiding collar is bolted to a bottom bracket on a bottom edge of the four-sided box. The housing is filled with the energy absorbing material. The energy absorbing material is preferably granulated rubber, but other materials may also be used.

The support structure preferably includes a first side leg, a second side leg, a rear leg base plate, a side reinforcement plate, a first side leg base plate and a second side leg base plate. The first leg includes a first side leg and a first rear leg. The first rear leg extends from the first side leg. The second leg includes a second side leg and a second rear leg. The second rear leg extends from the second side leg. A first end of the side reinforcement plate is attached to the first side leg and a second end of the reinforcement plate is attached to the second side leg. The first side leg is preferably bolted to the first side plate. The second side leg is preferably bolted to the second side plate. A bottom of the first side leg is attached to the first side leg base plate and a bottom of the second side leg is attached to the second side leg base plate. The rear leg base plate includes a first leg projection and a second leg projection. A bottom of the first rear leg is preferably bolted to the first leg projection and a bottom of the second rear leg is preferably bolted to the second leg projection. The support structure acts as a tripod to support the housing.

Still other advantages, aspects and features of the present methods and apparatus will become readily apparent to those skilled in the art from the following description wherein there are shown and described example embodiments, simply by way of illustration of one of the best modes best suited for to carry out the example embodiments. As it will be realized, the embodiments are capable of other different embodiments and its several details are capable of modifications in various obvious aspects all without departing from the scope of this disclosure.

Accordingly, it is an object of the present invention to provide a bullet trapping apparatus, which includes increased bullet deceleration with an angled back plate.

These and additional objects, advantages, features and benefits of the present invention will become apparent from the following specification.

DETAILED DESCRIPTION OF THE PREFERRED EMBODIMENTS

Figure 1:
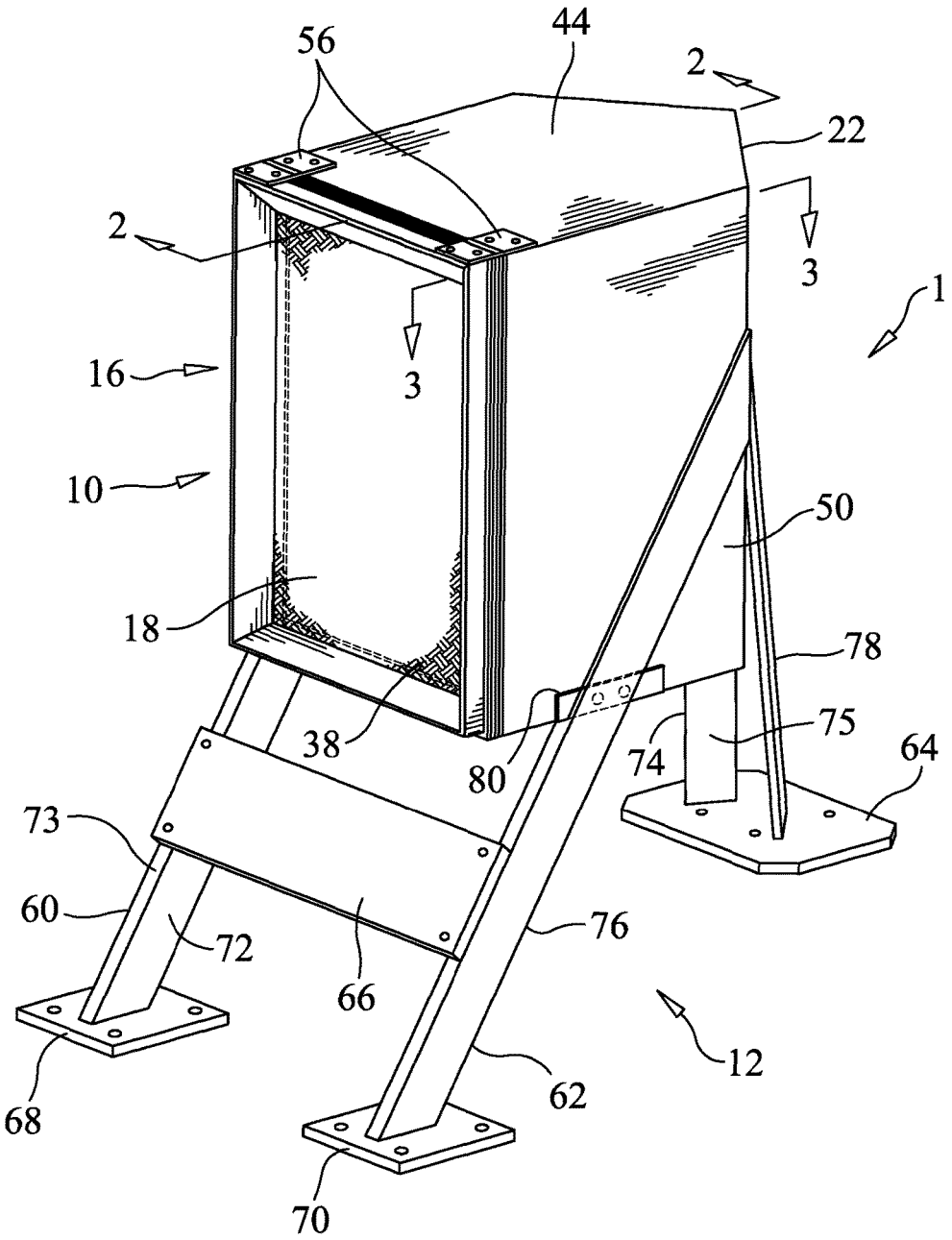
FIG. 1 is a perspective view of a bullet trapping apparatus in accordance with the present invention.
Figure 2:
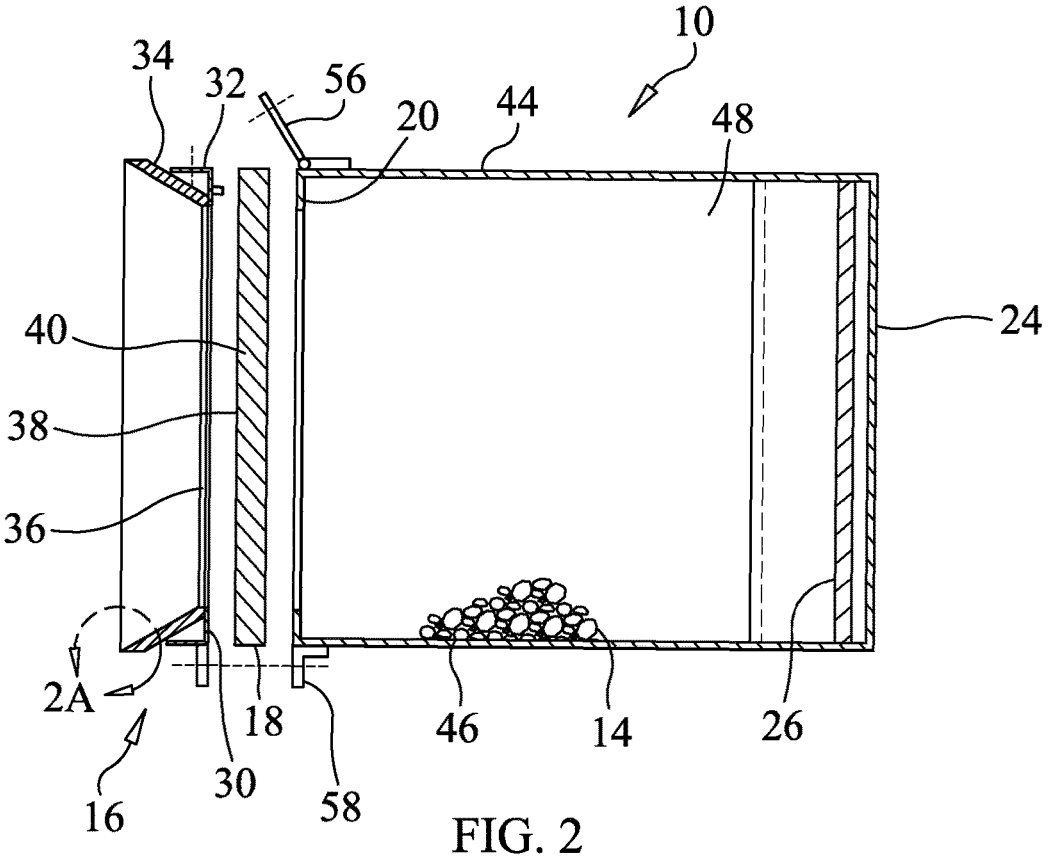
FIG. 2 is a partially exploded cross sectional view of a housing of a bullet trapping apparatus cut through FIG. 1 in accordance with the present invention.
Figure 2A:
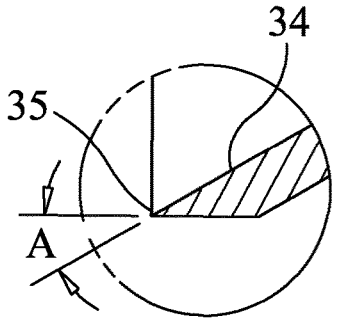
FIG. 2*a* is an enlarged cross sectional view of a four-sided angled flange of a partially exploded cross sectional view of a housing of a bullet trapping apparatus cut through FIG. 1 in accordance with the present invention.
Figure 3:
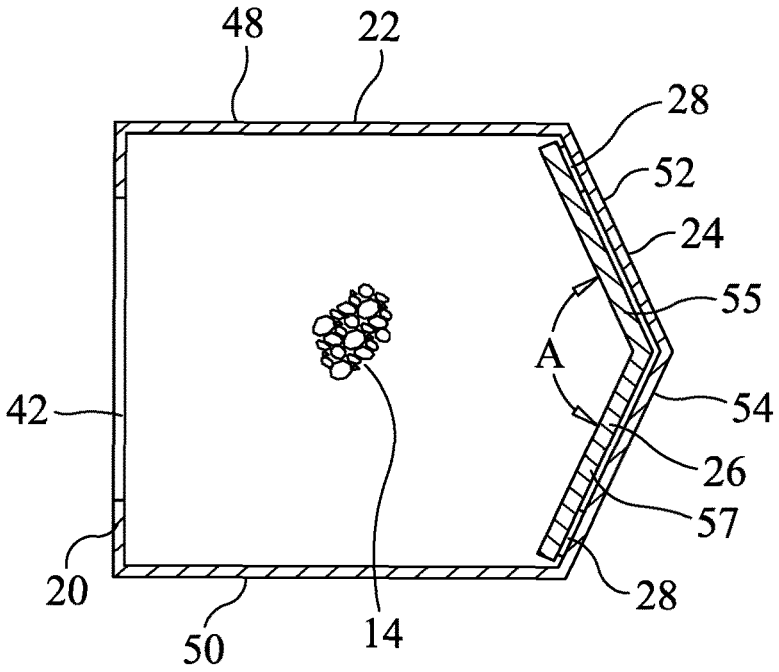
FIG. 3 is a cross sectional view of a portion of a housing of a bullet trapping apparatus cut through FIG. 1 in accordance with the present invention.

With reference now to the drawings, and particularly to FIG. 1, there is shown a perspective view of a bullet trapping apparatus 1. With reference to FIGS. 2-3, the bullet trapping apparatus 1 preferably includes a housing 10, a support structure 12 and energy absorbing material 14. The housing 10 preferably includes a bullet guiding collar 16, a front energy absorbing panel 18, a front wall plate 20, a four-sided box 22, an angled back plate 24, an angled armor plate 26 and a plurality of armor spacers 28. The bullet guiding collar 16 preferably includes a base plate 30, a four-sided peripheral wall 32 and a four-sided angled flange 34. The base plate 30 includes a rectangular base opening 36. The four-sided peripheral wall 32 is preferably perpendicular to the base plate 30 and attached to the base plate 30 with welding or any suitable attachment method. The four-sided angled flange 34 is attached to the four-sided peripheral wall 32 and to the base plate 30 with welding or any suitable attachment method. The four-sided flange 34 preferably includes an angled front edge 35. The angled front edge 35 includes an angle "A." The value of angle "A" is preferably 30 degrees, but other values may also be used. The angle front edge 35 will split a projectile. The front energy absorbing panel 18 is preferably fabricated from one of a screen and a fabric material 38 laminated to a front of a rubber material 40. The front energy absorbing panel 18 decelerates motion of a projectile and deforms a shape of the projectile. The front wall plate 20 includes a rectangular opening 42 formed therethrough.

The four sided box 22 includes a top plate 44, a bottom plate 46, a first side plate 48 and a second side plate 50. Edges of the top, bottom, first side and second side plates 44, 46, 48, 50 are attached to each other to form the four-sided box 22 with welding or any suitable attachment method. The front wall plate 20 is attached to a front of the four-sided box 22. The front energy absorbing panel 18 is located between the base plate 30 of the bullet guiding collar 16 and the front wall plate 20. The angled back plate 24 includes a first angled back plate 52 and a second angled back plate 54. The top and bottom plates 44, 46 include a pentagon shape to cover angled back plate 24. Adjacent edges of the first and second angled back plates 52, 54 are joined to each other with welding or any suitable attachment method. A perimeter of the angled back plate 24 is attached to a perimeter of a rear of the four-sided box with welding or any suitable attachment method.

Preferably, the four armor spacers 28 are attached in four corners of the back plate 24. The angled armor plate 26 includes a first armor plate 55 and a second armor plate 57. The first and second armor plates 55, 57 are preferably fabricated from AR-500 hardened armor plate. Alternatively, the angled armor plate 26 could be substituted for the angled back plate 24. Adjacent edges of the first and second angled armor plates 55, 57 are joined to each other with welding or any suitable attachment method. The most preferable value of an included angle "A" between the first and second armor plates 55, 57 is an obtuse angle of 120 degrees. The 120 degree angle of the angled armor plate 26 prevents the projectile from ricocheting back at a shooting source of the projectile. A second preferable value of angle "A" is between 115-125 degrees. However, angle "A" may also have other values. A rear of the angled armor plate 26 is glued to the four armor spacers 28. The four armor spacers 28 are preferably fabricated from a resilient material, such as rubber. A top edge of the bullet guiding collar 16 is preferably hinged to a top of the four-sided box 22 with a pair of hinges 56 or the like, such that a space is created for the insertion of the front energy absorbing panel 18. A bottom edge of the bullet guiding collar 16 is bolted to a bottom bracket 58 on a bottom edge of the four-sided box 22. The housing 10 is filled with the energy absorbing material 14 to decelerate motion of a projectile fired into the housing 10. The energy absorbing material 14 is preferably granulated rubber, but other materials may also be used. The energy absorbing material 14 is preferably sufficient to stop the motion of a projectile. The armor plate 18

In use, a projectile fired into the bullet trapping apparatus 1 will pass through the front energy absorbing panel 18; into the energy absorbing material 14 and stop within the energy absorbing material 14. However as a fail safe for a projectile, which has too much power, the projectile will hit at least one of the first and second plates of the angled back plate 24 or the angled armor plate 26; and come to a stop.

Figure 5:
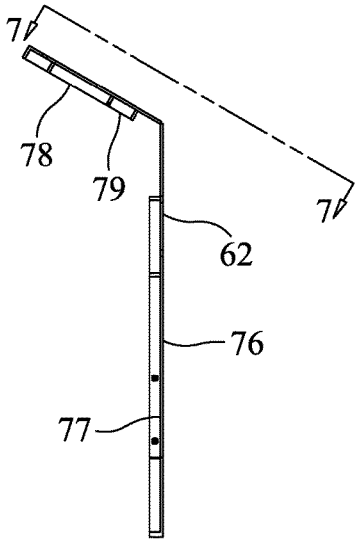
FIG. 5 is a top view of a second side leg of a bullet trapping apparatus in accordance with the present invention.
Figure 7:
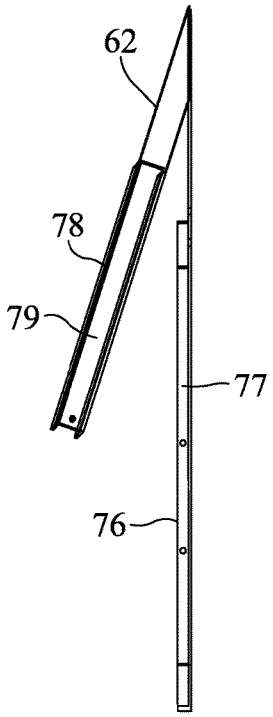
FIG. 7 is a side view of FIG. 5 of a second leg of a bullet trapping apparatus in accordance with the present invention.
Figure 6:
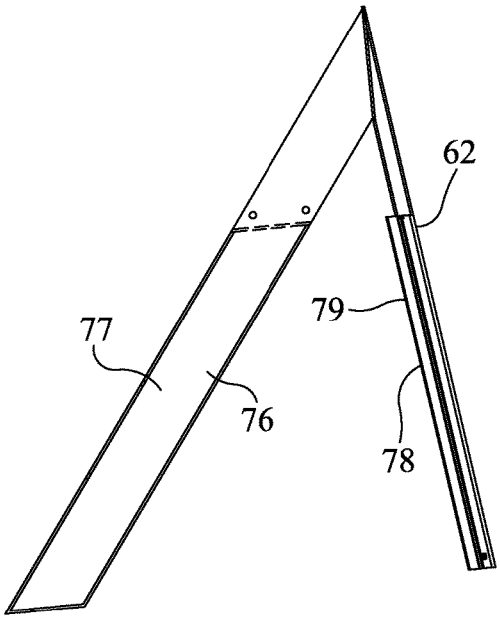
FIG. 6 is a side view of a second leg of a bullet trapping apparatus in accordance with the present invention.

With reference to FIGS. 5-7, the support structure 12 preferably includes a first leg 60, a second leg 62, a rear leg base plate 64, a side reinforcement plate 66, a first side leg base plate 68 and a second side leg base plate 70. The support structure 12 elevates the housing 10. The first leg 60 includes a first side leg 72 and a first rear leg 74. A top of the first rear leg 74 extends downward from a top of the first side leg 72. A first side portion 73 of the first side leg 72 preferably includes a U-shaped cross section and a first rear portion 75 of the first rear leg 74 preferably includes a U-shaped cross section. The second leg 62 includes a second side leg 76 and a second rear leg 78. A top of the second rear leg 78 extends downward from a top of the second side leg 76. A second side portion 77 of the second side leg 76 preferably includes a U-shaped cross section and a second rear portion 79 of the second rear leg 78 preferably includes a U-shaped cross section. The second leg 62 is a mirror image of the first leg 60.

Figure 4:
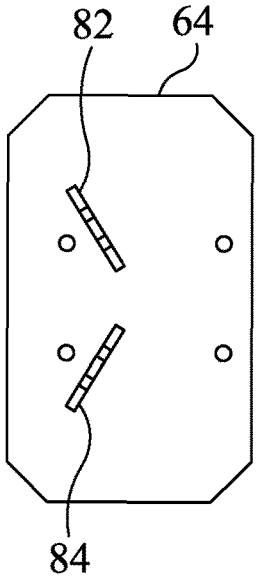
FIG. 4 is a top view of a rear leg base plate of a bullet trapping apparatus in accordance with the present invention.

A first end of the side reinforcement plate 66 is attached to the first side leg 72 and a second end of the reinforcement plate 66 is attached to the second side leg 76 with fasteners or the like. A leg reinforcement plate 80 is preferably attached to the first and second side plates 48, 50. The first side leg 72 is preferably bolted to the first side plate 48. The second side leg 76 is preferably bolted to the second side plate 50. A bottom of the first side leg 72 is attached to the first side leg base plate 68 and a bottom of the second side leg 76 is attached to the second side leg base plate 70. With reference to FIG. 4, the rear leg base plate 64 includes a first leg projection 82 and a second leg projection 84. A bottom of the first rear leg 74 is preferably bolted to the first leg projection 82 and a bottom of the second rear leg 78 is preferably bolted to the second leg projection 84. The support structure 14 acts as a tripod to support the housing 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A bullet trapping apparatus comprising:

an energy absorbing material;

a housing includes a front energy absorbing panel, a bullet guiding collar, a four sided box, an angled back plate and an angled armor plate, said front energy absorbing panel decelerates motion of a projectile, said bullet guiding collar includes an angled peripheral flange, said four sided box includes a first side plate, a second side plate, a top plate and a bottom plate, said front energy absorbing panel is retained on a front of said four sided box, said angled back plate includes a first angled back plate and a second angled back plate, said top and bottom plates include a pentagon shape to cover said angled back plate, said angled armor plate includes a first armor plate and a second armor plate, an obtuse angle is maintained between said first and second armor plates, an end of said first armor plate is joined to an end of said second armor plate, said angled armor plate is retained in front of said angled back plate, a joint between said first and second armor plates lies in a vertical axis, wherein said housing is filled with said energy absorbing material to decelerate motion of a projectile; and a support structure includes a first leg and a second leg, said first leg includes a first side leg and a first rear leg, a top of said first rear leg extends downward from a top of said first side leg, said second leg includes a second side leg and a second rear leg, a top of said second rear leg extends downward from a top of said second side leg, said first side leg is attached to said first side plate, said first rear leg is attached to said first angled back plate, said second side leg is attached to said second side plate, said second rear leg is attached to said second angled back plate, a first obtuse angle is formed between said first side leg and said first rear leg, a second obtuse angled is formed between said second side leg and said second rear leg.

2. The bullet trapping apparatus of claim 1 wherein:

said bullet guiding collar includes a base plate, a four-sided peripheral wall and said angled peripheral flange, said base plate includes a rectangular base opening, said four-sided peripheral wall is attached to said base plate, said angled peripheral flange is attached to base plate and said four-sided peripheral wall.

3. The bullet trapping apparatus of claim 1, further comprising:

a first side leg base plate is attached to a bottom of said first side leg, a second side leg base plate is attached to a bottom of said second side leg, a rear leg base plate is attached to a bottom of said first and second rear legs.

4. The bullet trapping apparatus of claim 1 wherein:

said first armor plate has substantially the same height as said second armor plate.

* * * * *